United States Patent [19]

Asari et al.

[11] Patent Number: 4,977,774

[45] Date of Patent: Dec. 18, 1990

[54] PRESS DEVICE

[75] Inventors: Akira Asari; Kuniaki Kanda, both of Kobe; Hiroshi Okamoto, Ashiya; Masakazu Ueda, Kobe, all of Japan

[73] Assignee: Kabushiki Kaisha Kobe Seiko Sho, Kobe, Japan

[21] Appl. No.: 443,493

[22] Filed: Nov. 30, 1989

[30] Foreign Application Priority Data

Dec. 12, 1988 [JP] Japan ..... 63-314498

[51] Int. Cl.[5] ..... B21D 37/12

[52] U.S. Cl. ..... 72/456; 72/455; 72/350; 72/359; 72/453.02; 72/453.05; 100/214

[58] Field of Search ..... 72/455, 456, 350, 351, 72/352, 358, 359, 453.02, 453.05, 453.07; 100/214

[56] References Cited

U.S. PATENT DOCUMENTS

| | | | |
|---|---|---|---|
| 1,433,116 | 5/1921 | Beyer | 72/453.05 |
| 1,834,111 | 1/1931 | Rode | 72/350 |
| 3,861,192 | 1/1975 | Suzuki et al. | 72/456 |
| 4,599,885 | 7/1986 | Stone | 72/350 |
| 4,615,204 | 10/1986 | Yamamoto et al. | 72/456 |
| 4,694,678 | 9/1987 | Zeitlin et al. | 72/445 |

*Primary Examiner*—David Jones

*Attorney, Agent, or Firm*—Oblon, Spivak, McClelland, Maier & Neustadt

[57] ABSTRACT

A press device which is reduced in overall height thereof and in deformation of a press frame and can sufficiently support an eccentric load thereto. The press device comprises a press force generating unit disposed in a press frame and including a lid member secured to the press frame, a cross head having a cylinder chamber in which the lid member is fitted for axial sliding movement and having a blank holder at an end face thereof remote from the lid member, and a pressurizing member fitted for axial sliding movement in a portion of the cylinder chamber remote from the lid member. A shaping element is disposed in the press frame in an opposing relationship to the press force generating unit and has a shaping portion in which the pressurizing member is fitted. A guide element is connected to the cross head for guiding the cross head for axial sliding movement, and a cross head actuating device is connected to the cross head for axially moving the cross head under the guidance of the guide element independently of the pressurizing member.

7 Claims, 14 Drawing Sheets

PRESS DEVICE

BACKGROUND OF THE INVENTION

1. Field of the Invention

This invention relates to a press device which is used for shaping or closed die forging of a blank material such as a steel plate.

2. Description of the Related Art

A press device for shaping a blank material such as a steel plate by press work is already known wherein a press force generating means and a shaping element means are disposed in a vertically opposing relationship within a press frame provided for receiving a press thrust thereon and which includes a guide means for guiding a cross head for sliding movement in the direction of an axis of the press.

Such device will be described in outline with reference to FIGS. 13 to 15. The press device shown in FIGS. 13 to 15 includes a press frame 1 which is shown as of the wire winding type wherein a piano wire 2 is wound around an outer periphery of the press frame 1. The device further includes an upper pressure receiving plate 3 and a lower pressure receiving plate 4 secured in a vertically opposing relationship to each other within the press frame 1.

The press device further includes a press force generating means 5 which is composed of a lid member 6 secured to the upper pressure receiving plate 3, a cylinder 7 in which the lid member 6 is fitted, and a main ram or piston 8 also fitted in the cylinder 7. The main ram 8 has an outer circumferential flange 9 at an intermediate portion in an axial direction thereof and is fitted also in a cylindrical portion 11 of a cross head 10 below the cylinder 7.

The press device further includes a shaping element means 12 including a die member 14 mounted on the lower pressure receiving plate 4 and having a shaping portion 13 thereon. The shaping element means 12 has a plurality of knockout means 15 built therein.

The press device further includes a blank holder 16 mounted on the lower face of the cross head 10 for pressing against a blank material 17 on the die member 14.

The press device further includes four blank holder actuating cylinder devices 18, four balance cylinder devices 19, a pair of cross head lifting cylinder devices 20, and a pair of cross head guide means 21.

In the conventional press device, a blank material 17 on the die member 14 is shaped into a predetermined shape by operating the blank holder actuating cylinder devices 18 to move down the cross head 10 and the blank holder 16 to press against an outer peripheral portion of the blank material 17 and then causing an oil pressure (hydraulic pressure) to act in the cylinder 7 to move down the main ram 8 until a lower end portion of the main ram 8 is advanced into the shaping portion 13 of the die member 14.

After such shaping, the main ram 8 is moved up by the balance cylinder devices 19 and then the cross head 10 is moved up by the lifting cylinder devices 20 therefor.

FIG. 16 shows a press device for shaping a blank material into a shape which has an inclined face at a recessed portion thereof. Referring to FIG. 16, each of a main ram 8A and a shaping portion 13A has an inclined face thereon.

The conventional press device shown in FIGS. 13 to 15 has a problem that it is comparatively great in overall height and hence in overall size because the cross head 10 is disposed in a vertically opposing relationship below the cylinder 7 of the press force generating means 5.

Such great overall size of the press device gives rise to complication of the cross head guide means 21, increase in overall size of an exchanging means of a seal member for the main ram 8, increase in number of parts, deterioration in handling facility and so forth.

Further, since the press thrust is technically carried on the press frame 1, disposition of the cylinder 7 and the cross head 10 in a vertically opposing relationship within the press frame 1 will allow a comparatively great amount of deformation of the press frame 1, which gives rise to a disadvantage that the press frame 1 must be made very rigid and strong or else the press force must be excessively small. Such disadvantages must be eliminated whether the press frame 1 is of the column type, the wire winding type or any other type, but they are a serious problem particularly in a press device of the wire winding type because it is deformed upon winding of a wire or upon application of a load (upon shaping operation).

On the other hand, the case of the press device shown in FIG. 16 wherein the main ram 8A and the shaping portion 13A have inclined face portions thereon, an eccentric load is produced during shaping, which will give rise to a bending moment. A lateral load caused by such bending moment is received by the cross head guide means 21 having a gate-like configuration. However, since a pair of supporting portions 21A and 21B of the guide means 21 are vertically spaced by a comparatively great distance from each other, a guide rod 21C of the guide means 21 must necessarily have a large diameter. Or otherwise, there is a possibility that the guide rod 21C of the guide means 21 may be put into a non-usable condition particularly with a wire winding press frame which is comparatively low in rigidity against a load acting in a lateral direction.

SUMMARY OF THE INVENTION

It is an object of the present invention to provide a press device which is reduced in overall height and also reduced in deformation of a press frame.

It is another object of the present invention to provide a press device which can sufficiently support an eccentric load thereto.

In order to attain the objects, according to the present invention, a press device wherein a press force generating means and a shaping element means are disposed in an opposing relationship to each other within a press frame provided for carrying a press thrust and a blank holder for pressing a blank material against the shaping element means side is provided on the press force generating side is provided with the following technical means.

In particular, according to the present invention, the press force generating means is constructed such that a lid member is secured to the press frame and fitted in a cylinder chamber of a cross head, which is movable in an axial direction of the press device, over a distance greater than the stroke of movement of the cross head and besides a pressurizing member is fitted for sliding movement in a portion of the cylinder chamber remote from the lid member, and the blank holder is provided on the side of the cross head adjacent the shaping element means while a cross head actuating means is provided for moving the cross head having the blank holder independently of the pressurizing member.

According to the feature of the present invention, the press force generating means is constructed such that the lid member is secured to the press frame and fitted in the cylinder chamber of the cross head, which is movable in the axial direction of the press device, over a distance greater than the stroke of movement of the cross head and besides the pressurizing member is fitted for sliding movement in the portion of the cylinder chamber remote from the lid member. Here, the press force generating means is built in the cross head, and accordingly, the overall height of the press device is reduced.

If a blank material is placed on the shaping element means and then the blank holder is moved down together with the cross head by the cross head actuating means to press against the blank material whereafter a hydraulic pressure (oil pressure) is caused to act in the cylinder chamber of the cross head in this condition, then a thrust acts, since the lid member is fixed, upon the pressurizing member to shape the blank material whereupon the pressurizing member acts as a male die.

Since the press force generating means is built in the cross head, the overall height of the press device can be reduced, and consequently, amounts of possible deformation of various portions of the press device including the press frame can be reduced.

Consequently, a shaped product of a high quality can be obtained wherein simplification of a guide means for the cross head and improvements in handling facility such as exchanging of a seal member can be anticipated and besides maintenance thereof can be carried out readily and accurately.

Since the cross head is utilized also as the blank holder and part of the press force generating means, reduction in weight and also in number of parts can be realized.

The above and other objects, features and advantages of the present invention will become apparent from the following description and the appended claims, taken in conjunction with the accompanying drawings wherein like parts are denoted by like reference numerals all through the drawings.

BRIEF DESCRIPTION OF THE DRAWINGS

FIG. 11(2) is a sectional view taken along line E—E of FIG. 11(1);

FIG. 12(2) is a sectional view taken along line F—F of FIG. 12(1);

DETAILED DESCRIPTION OF THE PREFERRED EMBODIMENTS

Figure 1:
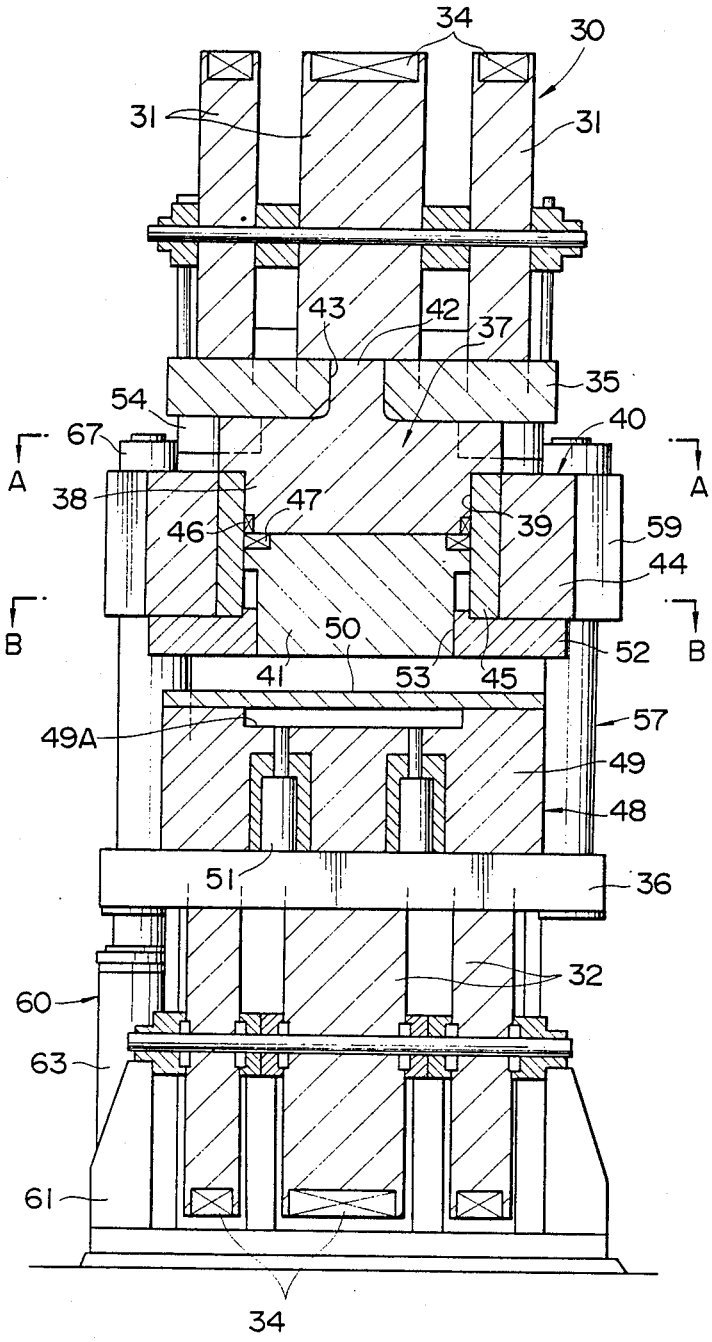
FIG. 1 is a vertical sectional view of a press device showing a first preferred embodiment of the present invention.

Referring first to FIGS. 1 to 4, there is shown a press device according to a first preferred embodiment of the present invention. The press device shown includes a press frame 30 which is composed of a pair of complementary semicircular yokes 31 and 32 and a column 33 interconnecting the yokes 31 and 32. A set of piano wires 34 are wound around an outer periphery of the press frame 30.

An upper receiving plate 35 is mounted on a lower end face of the upper yoke 31 while a lower receiving plate 36 is mounted on an upper end face of the lower yoke 32. The upper receiving plate 35 and the lower receiving plate 36 are disposed in a vertically opposing relationship to each other. It is to be noted that the upper and lower receiving plates 35 and 36 may be formed in an integral relationship with the upper and lower yokes 31 and 32, respectively.

The press device further includes a press force generating means 37 which is composed of a lid member 38, a cross head 40 having a cylinder chamber 39 formed therein in which the lid member 38 is fitted, a pressurizing member 41 also fitted in the cylinder chamber 39 of the cross head 40, and so forth.

The lid member 38 has a projection 42 at the center of the top thereof and is secured within the press frame 30 by way of the upper receiving plate 35 with the projection 42 thereof fitted in a centering hole 43 formed at a location of the upper receiving plate 35 on an axial line of the press device.

The cross head 40 is composed of an outer tube member 44 and an inner tube member 45 coupled to the outer tube member 44 by shrinking fitting. The inner tube member 45 has an inner circumferential face finished into a mirror face so as to define the cylinder chamber 39. A seal member 46 is provided on an outer periphery of the lid member 38 fitted in the cylinder chamber 39.

Here, since the cross head 40 is movable in upward and downward directions while the lid member 38 is fixed, the distance over which the lid member 38 is fitted in the cylinder chamber 39 of the cross head 40 is greater than the extent of a stroke of the cross head 40 in the upward and downward directions.

The pressurizing member 41 has a seal member 47 on an outer periphery of an upper portion thereof and is fitted for up and down movement in the cylinder chamber 39 by way of the seal member 47. The lower end face side of the pressurizing member 41 substantially functions as a male die of the press device.

Accordingly, if a hydraulic pressure such as an oil pressure not shown is supplied into a spacing between the lower end face of the lid member 38 and the upper end face of the pressurizing member 41 by way of a flow path or the like, then a thrust in the downward direction (pressing direction) is produced at the pressurizing member 41 because the lid member 38 is fixed.

The press device further includes a shaping element means 48 having a shaping portion 49 into which the pressurizing member 41 can be advanced.

It is to be noted that reference numeral 50 denotes a blank material such as a steel plate, and 51 a product knockout means.

The press device further includes a blank holder 52 mounted on that side of the cross head 40 opposing to the shaping element means 48, that is, on the lower end face of the cross head 40 in the arrangement shown, by means of a bolt or the like not shown. The pressurizing member 41 is fitted for sliding movement in a center bore 53 formed in the blank holder 52. It is to be noted that, while it is advantageous to removably mount the blank holder 52 on the cross head 40, it may otherwise be formed in an integral relationship on the cross head 40.

Figure 3:
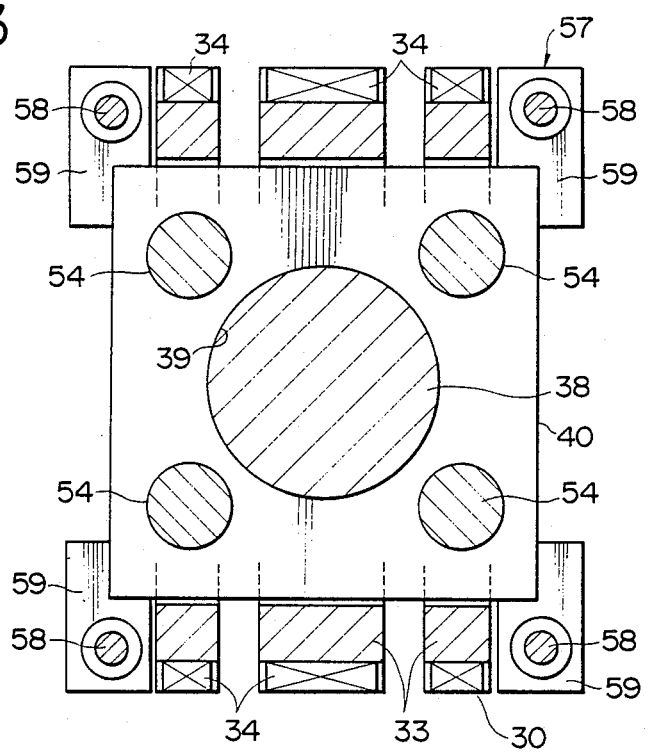
FIG. 3 is a sectional view taken along line A—A of FIG. 1.
Figure 4:
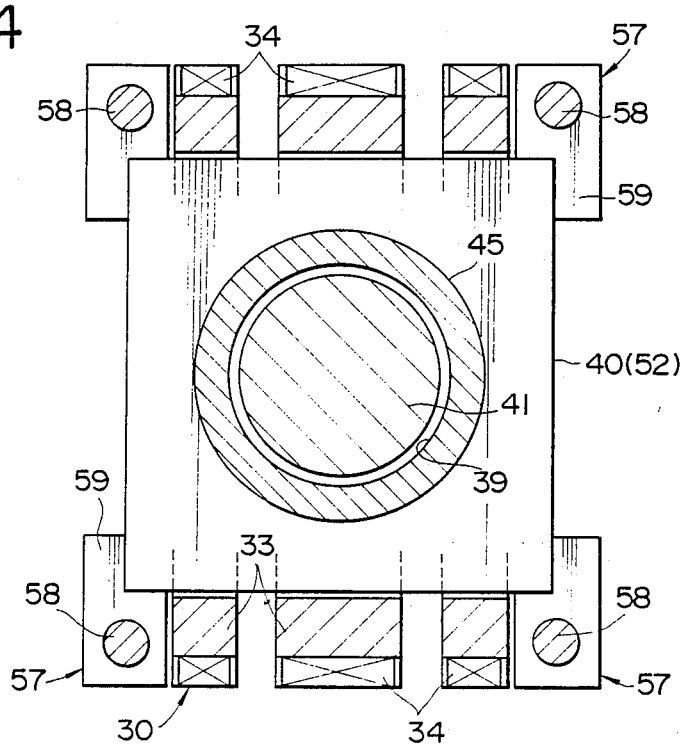
FIG. 4 is a sectional view taken along line B—B of FIG. 1.

The press device further includes four first cross head actuating means 54 disposed at such four corner locations as seen in FIGS. 3 and 4 for operating the cross head 40 and the blank holder 52 in an integral relationship independently of the pressurizing member 41. Each of the first cross head actuating means 54 includes a cylinder portion 55 provided on the upper receiving plate 35 side, and a piston rod portion 56 fitted in the cylinder portion 55 for upward and downward movement by a hydraulic pressure (oil pressure). The first cross head actuating means 54 are provided to move down the cross head 40.

The press device further includes four guide means 57 disposed similarly at such four corner locations as seen in FIGS. 3 and 4. The guide means 57 each includes a guide rod 58 extending in the upward and downward directions between the lower receiving plate 36 and the cross head 40, a guide shoe 59 and so forth.

The press device further includes a pair of second cross head actuating means 60. Each of the second cross head actuating means 60 includes a cylinder portion 63 provides uprightly on a base 61, and a piston 62 formed at an extension below the lower receiving plate 36 of each of two of the guide rods 58 of the guide means 57 at diagonal locations and fitted in the cylinder portion 63. The cross head 40 is moved up by application of a hydraulic pressure (oil pressure) to the cylinder portions 63 of the second cross head actuating means 60.

Figure 2:
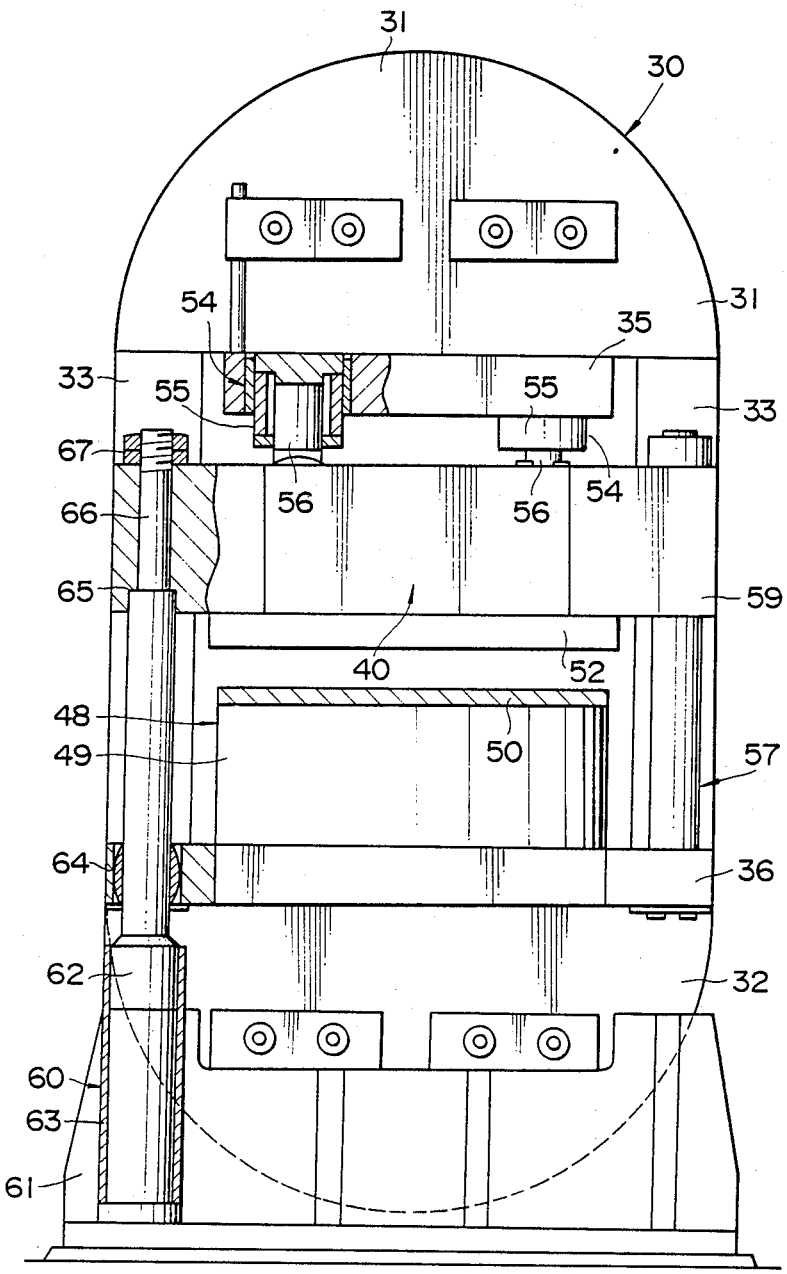
FIG. 2 is a front elevational view, partly broken, of the press device shown in FIG. 1.

It is to be noted that the piston rods (guide rods) 58 of the second cross head actuating means 60 are supported on the lower receiving plate 36 by means of spherical bearings 64 as shown in FIG. 2 while they extend at smaller diameter shaft portions 66 thereof through and are fastened to the cross head 40 by means of nuts 67 and stepped portions 65 of the piston rods (guide rods) 58.

While the press device of the present embodiment includes the second cross head actuating means 60 as lifting means of an actuating means for lifting or lowering the cross head 40 and includes the first cross head actuating means 54 as lowering means of the actuating means, either ones of them may be omitted where the other area of the double acting type.

Figure 5:
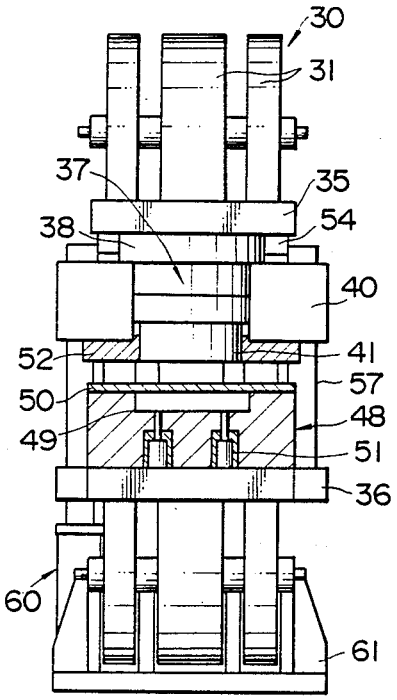
FIGS. 5(1) to 5(5) are elevational views illustrating difference steps of a press cycle of the press device shown in FIG. 1.
Figure 5:
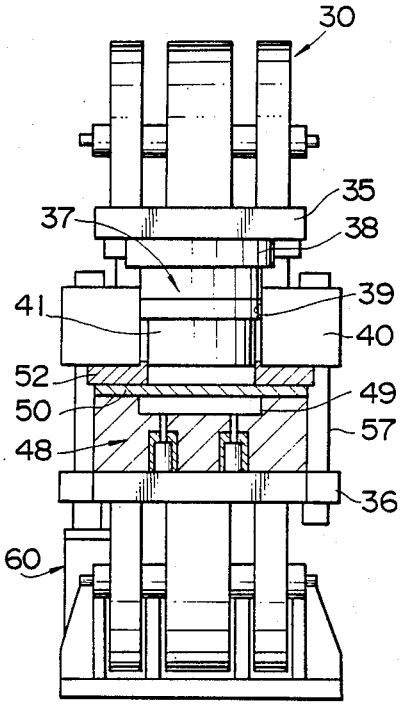
Figure 5:
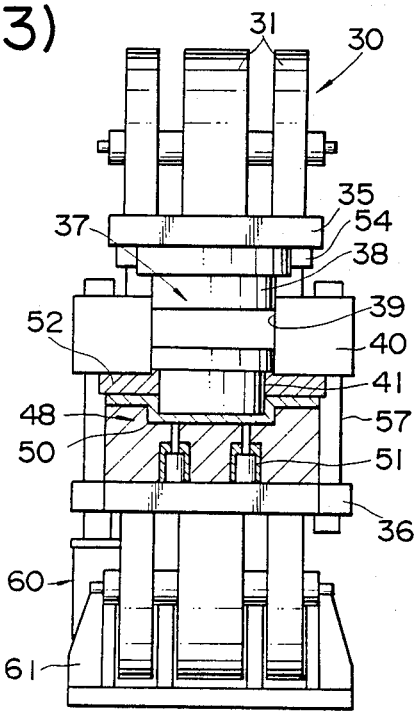
Figure 5:
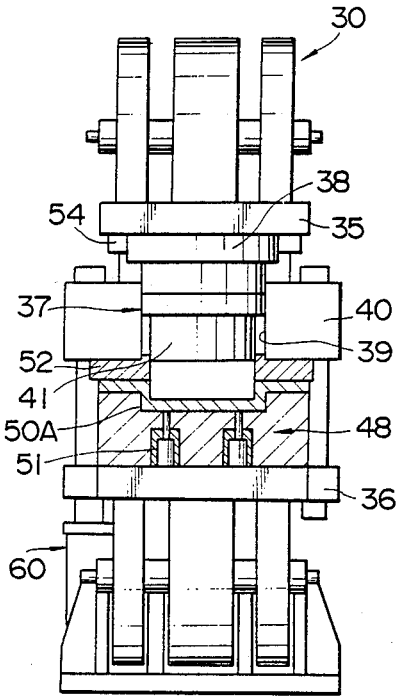
Figure 5:
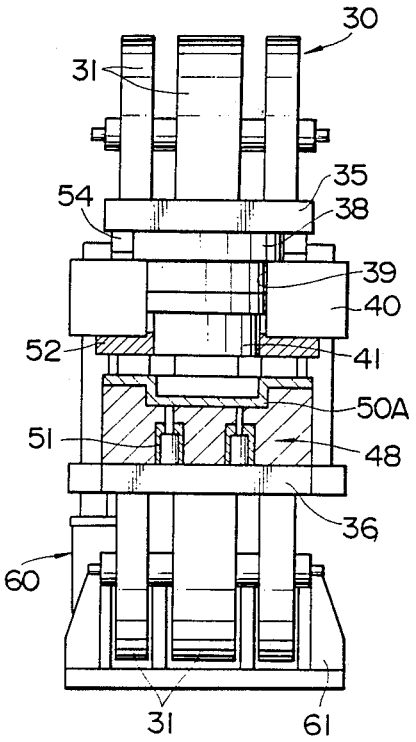

Subsequently, operation of the press device of the first embodiment described above will be described with reference to FIGS. 5(1) to 5(5). FIG. 5(1) shows an initial condition of the press device wherein a blank material 50 is set in position on the shaping element means 48.

The first cross head actuating means 54 is thus rendered operative to move down the cross head 40 and the blank holder 52 so that the blank material 50 is pressed at a portion thereof around the shaping portion 49 of the shaping element means 48 as shown in FIG. 5(2). During the step, since the distance over which the lid member 38 is fitted in the cylinder chamber 39 of the cross head 40 is greater than the stroke of the cross head 40, the cross head 40 will be guided without coming off from the lid member 38.

Subsequently, a hydraulic pressure (oil pressure) is caused to act in the cylinder chamber 39 of the cross head 40. Consequently, the pressurizing member 41 is moved down to advance into the shaping portion 49 of the shaping element means 48 to perform predetermined press work wherein the shaping portion 49 serves as a female die while the pressurizing member 41 serves as a male die.

In particular, since the lid member 38 is fixed while the pressurizing member 41 can slidably move, when a hydraulic pressure acts in the cylinder chamber 39, the pressurizing member 41 is acted upon by a thrust in the pressing direction thereby to perform press shaping of the blank material 50 (refer to FIG. 5(3)).

While the press thrust is received (shared) by the press frame 30, since the cylinder chamber 39 of the cross head 40 is built in as the press force generating means 37, the press frame 30 is reduced in height and accordingly, possible deformation of the press frame 30 is reduced.

After completion of a predetermined press shaping operation, the pressurizing member 41 is acted upon at the lower face side thereof by a fluid pressure so that it is moved upwardly (refer to FIG. 5(4)). Then, the cross head 40 is moved up together with the blank holder 52 by the second cross head actuating means 60 (refer to FIG. 5(5)), and a product 50A is taken out from the shaping portion of the shaping element means 48, thereby completing the press cycle.

It is to be noted that the spherical bearings 64 function so that the guide rods 58 may be directed always in the vertical directions when the lower receiving plate 36 is deformed.

Figure 6:
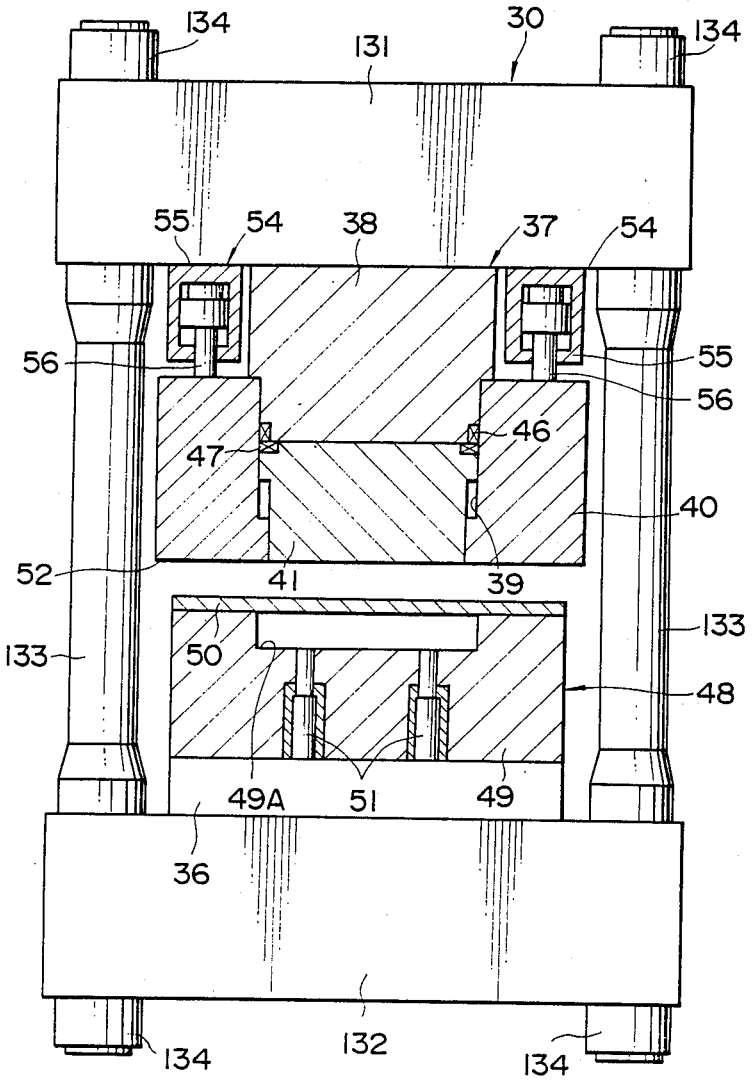
FIG. 6 is a vertical sectional view of a press device showing a second preferred embodiment of the present invention.

Referring now to FIG. 6, there is shown a press device according to a second preferred embodiment of the present invention. The press device is substantially similar in construction and operation to the press device of the first embodiment described hereinafter except that a press frame 30 is composed of a top platen 131 and a bottom platen 132 coupled to the top platen 131 by means of a plurality of columns 133 and nuts 134.

Figure 7:
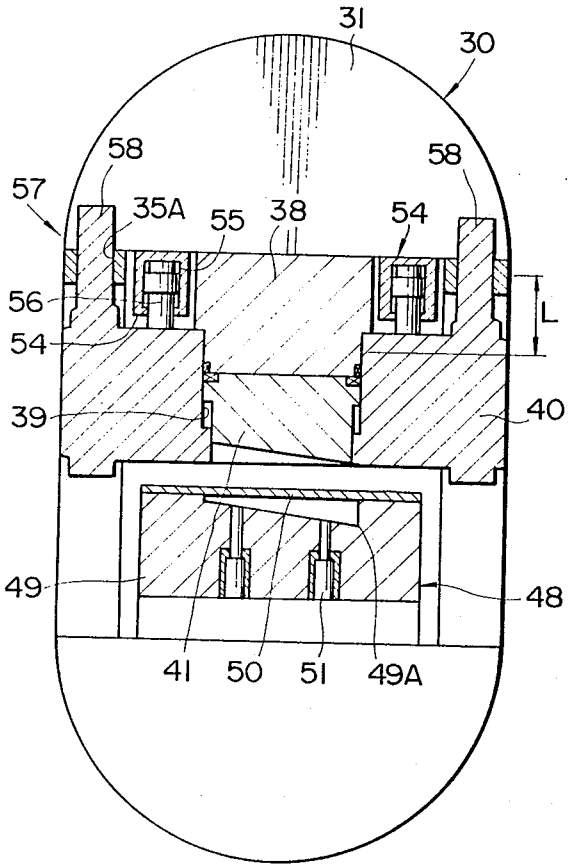
FIG. 7 is a vertical sectional view of a press device showing a third preferred embodiment of the present invention.
Figure 16:
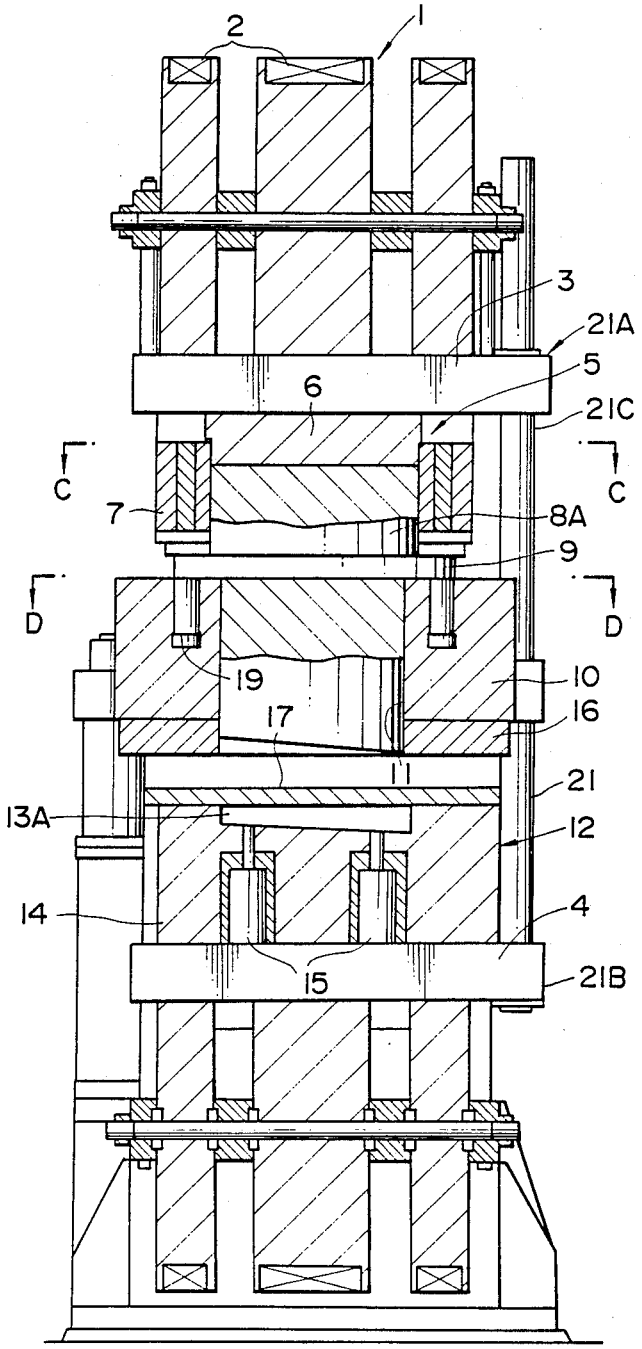
FIG. 16 PRIOR ART
FIG. 16 is a vertical sectional view of another conventional press device.

Referring now to FIG. 7, there is shown a press device according to a third preferred embodiment of the present invention which is a modification to the press device of the first embodiment described above in that the guide means 57 of the press device of the first embodiment described above is modified such that the press device may be effective where each of the pressurizing member 41 and the shaping portion 49 of the shaping element means 48 has such an inclined face as in the conventional press device shown in FIG. 16. In the press device shown in FIG. 7, each of the guide rods 58 extends upwardly from the cross head 40 and extends for sliding movement into a guide hole 35A formed in the upper receiving plate 35 and serving as a supporting means in a lateral direction (horizontal direction) for a bending moment which may be produced upon application of an eccentric load during shaping (press work). A portion of the lid member 38 fitted in the cylinder chamber 39 also serves as a supporting means in a lateral direction (horizontal direction) for such bending moment. As the supporting means are provided in this manner, the span L between the upper and lower supporting means can be reduced to effectively cope with a bending moment caused by an eccentric load, and a reactive force of the press frame 30 in a lateral direction against an eccentric load can be reduced.

The point will be described again with reference to FIG. 8 in which a press device according to a fourth preferred embodiment of the present invention is shown. Where, for example, the shaping portion 49 of the shaping element means 48 has an inclined face portion thereon (although an eccentric load is produced from some other causes), an eccentric load and a reactive force F against the eccentric load are inevitably produced upon press shaping of a blank material 50. A bending moment $F \times e$ is produced by such eccentric load, and a lateral load caused by the bending moment is received, on the upper portion side, by the portion of the lid member 38 fitted in the cylinder chamber 39 ($F \times e = f \times L$) and, on the lower portion side, by a supporting portion 36A of the lower receiving plate 36 for the guide rods 58.

In particular, $e \times F = L \times f$, and hence $f = (e \times F)/L$. Here, the span L between the upper and lower supporting means is reduced, and accordingly, even where the press frame 30 has a structure which is comparatively weak against a load acting in a lateral direction, it can stand a lateral load without increasing the diameter, the cross sectional area and so forth of the columns 33 or 133.

Figure 8:
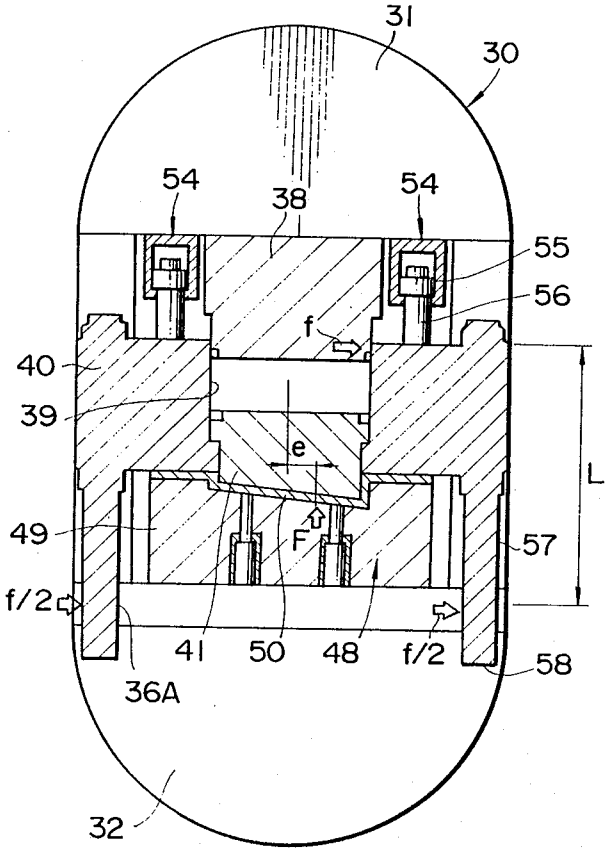
FIG. 8 is a vertical sectional view of a press device of a fourth preferred embodiment of the present invention illustrating a behavior against an eccentric load.

Further, as shown in FIG. 8, the gate-shaped guide means 57 are supported, on the upper portion side, by a supporting means for a lateral load provided by a portion of the lid member 38 fitted in the cylinder chamber 39 and, on the lower portion side, by lateral load supporting means provided by the supporting holes 36A formed in the lower receiving plate 36. The distance L between the upper and lower supporting means is thus reduced so as to reduce possible deformation of the press frame 30 or the like by a bending moment which may be produced by an eccentric load.

It is to be noted that, while the press force generating means 37 and the shaping element means 48 are arranged at upper and lower locations within the press frame 30 in each of the press devices of the embodiments described above, they may otherwise be arranged in an inverted relationship. Further, the press frame 30 need not be of the wire winding type or the column type but may be of some other type including the laminated steel plate type.

Figure 9:
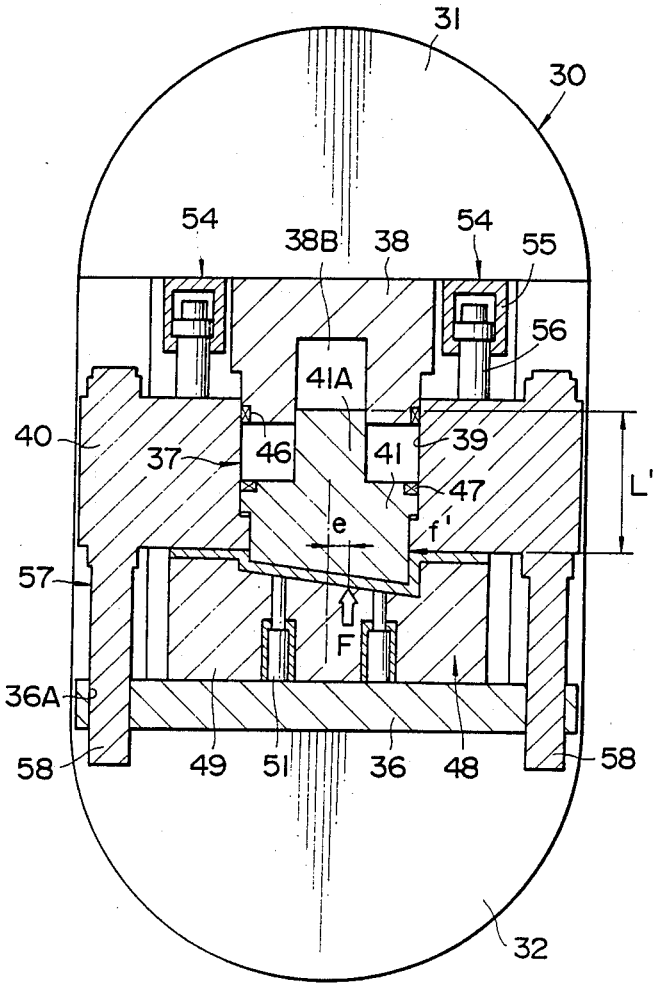
FIG. 9 is a vertical sectional view showing a fifth preferred embodiment of the present invention.
Figure 10:
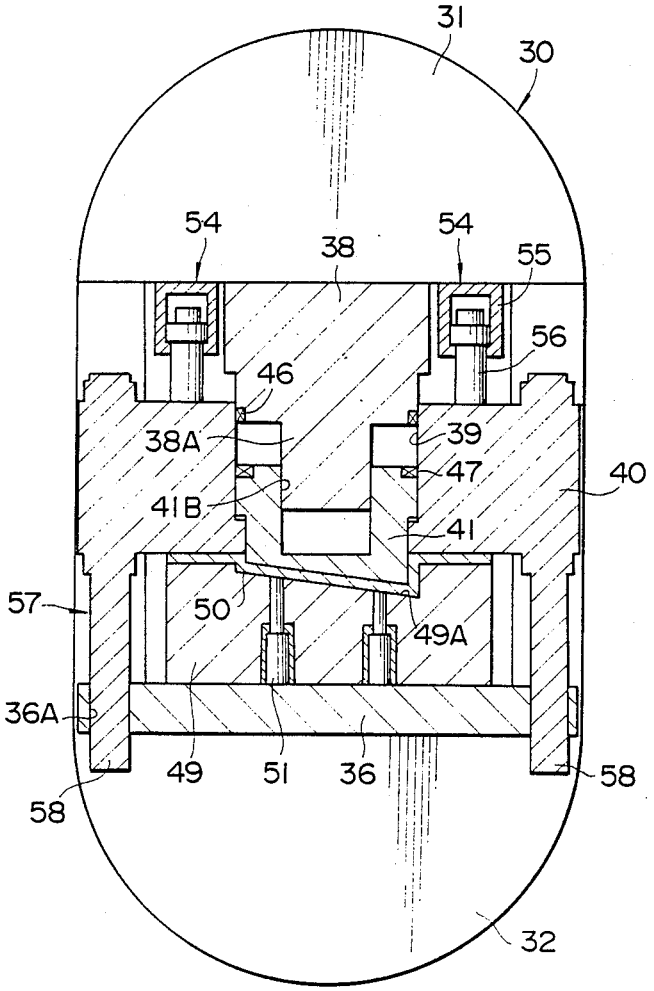
FIG. 10 is a vertical sectional view showing a sixth preferred embodiment of the present invention.

FIGS. 9 and 10 show press devices according to the fifth and sixth preferred embodiments of the present invention which are modifications also to the press device of the first embodiment described hereinabove. Referring first to FIG. 9, the pressurizing member 41 has a guide pin 41A extending upwardly therefrom in the axial direction of the press device. The lid member 38 has a guide hole 38B formed therein for receiving the guide pin 41A. The pressurizing member 41 and the lid member 38 are assembled for sliding movement to each other such that the guide pin 41A and the guide hole 38B are engaged in a telescopic relationship with each other in such a relationship that the pressurizing member 41 may be held on the lid member 38 at the end of the pressurizing stroke of the pressurizing member 41.

On the other hand, in the press device shown in FIG. 10, a guide pin 38A is formed on the lid member 38 while a guide hole 41B is formed in the pressurizing member 41.

In each of the press devices shown in FIGS. 9 and 10, the length L' between upper and lower supporting portions of the pressurizing member 41 is increased at least by the length of the guide pin 41A or 38A. Consequently, the lateral load f' is reduced, and accordingly, possible deformation of the press frame 30 is further decreased.

Further, the load to the seal member 47 for the pressurizing member 41 is reduced, and deformation and abrasion of the seal member 41 are also reduced, resulting in increase of the life of the seal.

It is to be noted that, while the guide pin 38A or 41A and the guide hole 41B or 38B are provided in a paired, vertically opposing relationship on the center line of the press device of each of the embodiments shown in FIGS. 9 and 10, they may be provided otherwise in a plurality of pairs.

Figure 11:
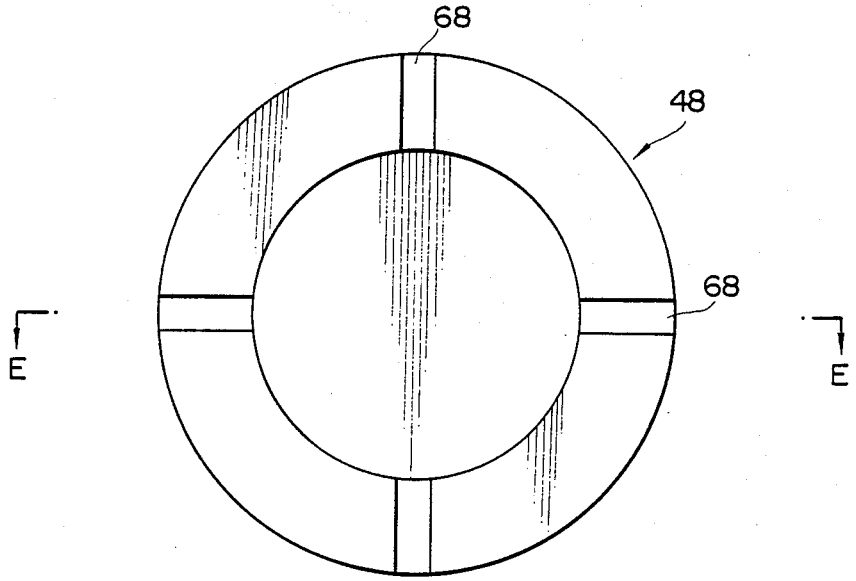
FIG. 11(1) is a top view of a shaping element means.
Figure 11:
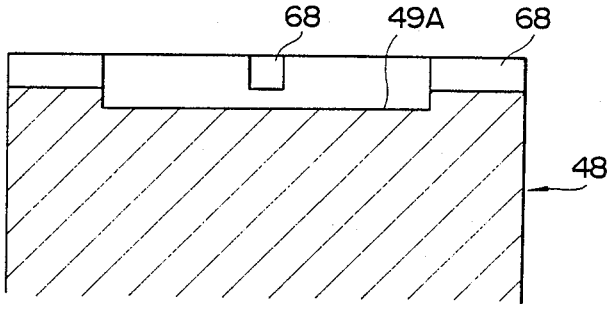
Figure 12:
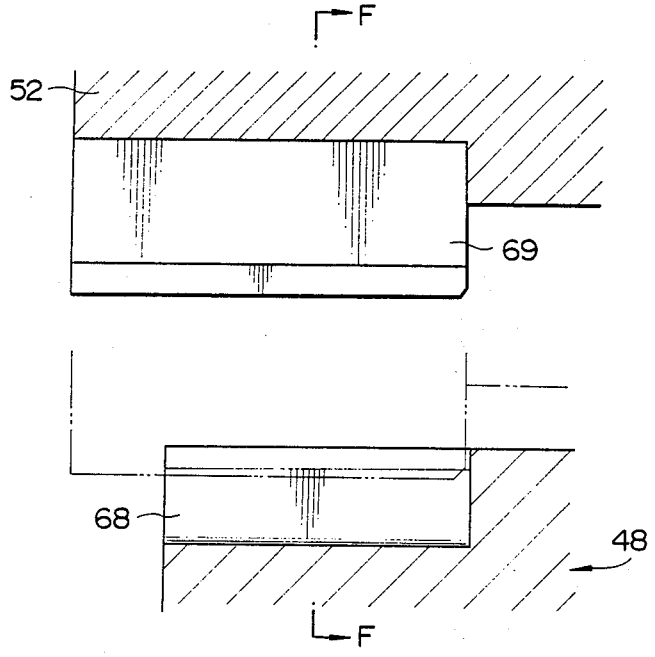
FIG. 12(1) is a grossly enlarged sectional view of a shaping element means and a blank holder.
Figure 12:
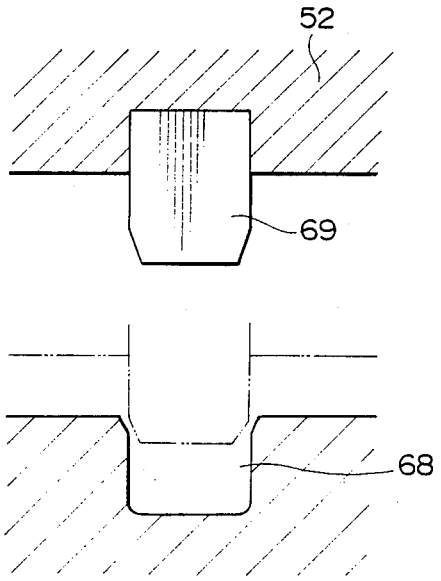
Figure 13:
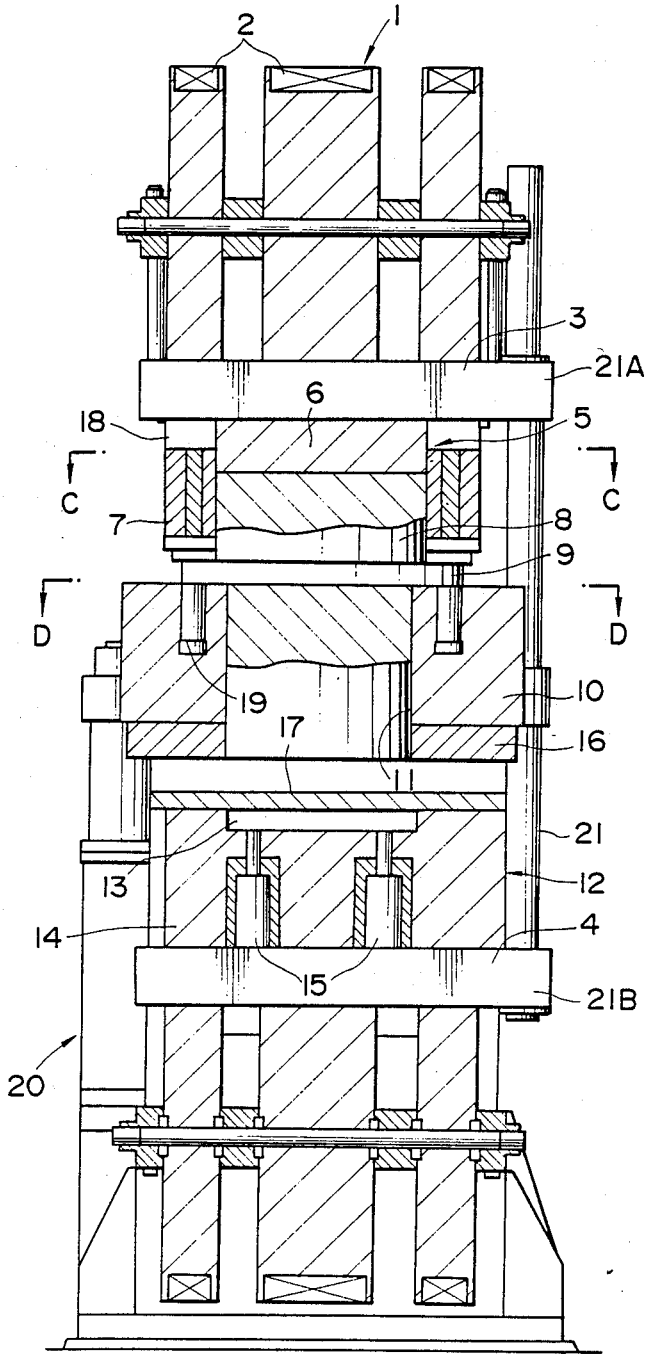
FIG. 13 PRIOR ART
FIG. 13 is a vertical sectional view of a conventional press device.
Figure 14:
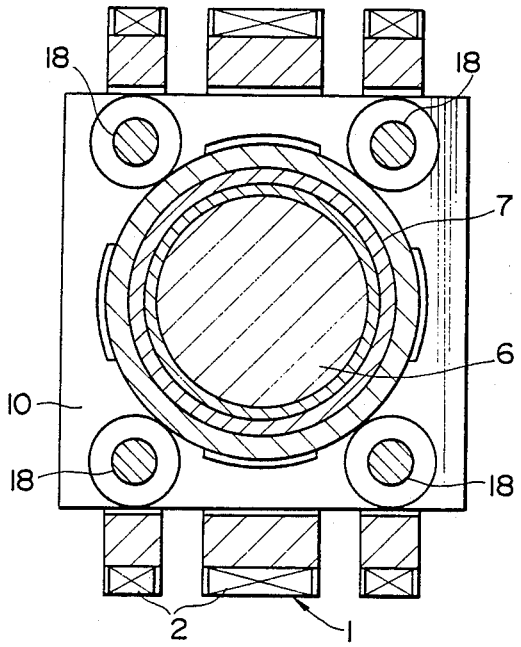
FIG. 14 PRIOR ART
FIG. 14 is a sectional view taken along line C—C of FIG. 13.
Figure 15:
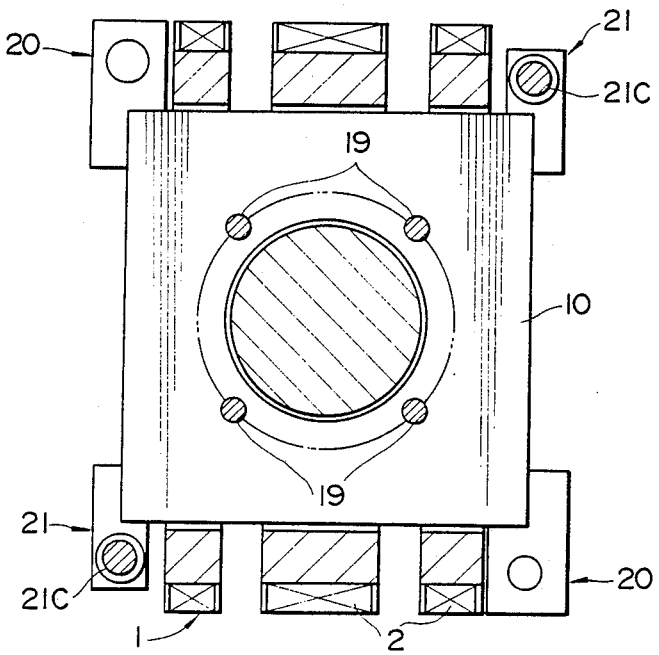
FIG. 15 PRIOR ART
FIG. 15 is a sectional view taken along line D—D of FIG. 13.

FIGS. 11(1), 11(2) and 12(1), 12(2) show a seventh preferred embodiment of the present invention wherein keys and key ways are provided on a blank holder and a shaping element means, respectively. FIG. 11(1) is a top plan view of the shaping element means while FIG. 11(2) is a sectional view taken along line E—E of FIG. 11(1). Referring to FIGS. 11(1) and 11(2), the shaping element means 48 has four key ways 68 formed radially from the axis of the press device in a circumferentially equidistantly spaced relationship on a circumferential edge portion thereof. On the other hand, the blank holder 52 has four keys 69 disposed thereon for individually engaging with the key ways 68 of the shaping element means 48 as shown in FIGS. 12(1) and 12(2). Upon operation of the press device, the keys 69 and the key ways 46 are individually engaged with each other to correct possible misalignment between the blank holder 52 and the shaping element means 48.

It is to be noted that the keys and the key ways are not limited to those shown in FIGS. 11(1), 11(2) and 12(1), 12(2), and the present invention can be put into practice so far as at least three such keys and key ways in pair are disposed radially from the axis of the press device. Further, the shape of the keys is not limited to that shown in FIGS. 11(1), 11(2) and 12(1) and 12(2). For example, each of the keys may be shaped in a tapered condition such that the width thereof may increase from its press axis side end toward its radially outer end side.

Further, while FIGS. 11(1) to 12(2) show an example wherein the keys 69 are formed on the blank holder 52 side and the key ways 68 are provided on the shaping element means 48 side, they may otherwise be provided in a reverse relationship. In particular, the key ways 69 may be provided on the blank holder 52 side.

Having now fully described the invention, it will be apparent to one of ordinary skill in the art that many changes and modifications can be made thereto without departing from the spirit and scope of the invention as set forth herein. For example, while a vertical press device is illustrated in any of the preferred embodiments shown in the drawings, naturally the present invention can be applied similarly to a horizontal press device. Further, while in any of the preferred embodiments shown in the drawings the press force generating means 37 is disposed at an upper location while the shaping element means 48 is disposed at a lower location, the present invention can naturally be applied to an arrangement wherein they are disposed in an inverted relationship.

The preferred embodiments described herein are therefore illustrative and not restrictive, the scope of the invention being indicated by the appended claims and all variations which come within the meaning of the claims being intended to be embraced therein.

What is claimed is:

1. A press device, comprising:

a press frame for transmitting a press thrust;

a press force generating means disposed in said press frame and including a lid member secured to said press frame, a cross head having a cylinder chamber in which said lid member is fitted for sliding movement in an axial direction of said press device and having a blank holder at an end face thereof remote from said lid member, and a pressurizing member fitted for sliding movement in a portion of said cylinder chamber of said cross head remote from said lid member in the axial direction of said press device relative to said cylinder chamber;

a shaping element means disposed in said press frame in an opposing relationship to said press force generating means and having a shaping portion in which said pressurizing member is fitted;

a guide means connected to said cross head for guiding said cross head for sliding movement in the axial direction of said press device; and a cross head actuating means connected to said cross head for moving said cross head having said blank holder in the axial direction of said press device under the guidance of said guide means independently of said pressurizing member.

2. A press device according to claim 1, wherein said lid member has at least one guide pin extending in the axial direction of said press device while said pressurizing member has at least one guide hole formed therein form receiving said guide pin, and said guide pin and said guide hole are engaged with each other in such a telescopic relationship that said pressurizing member may be held on said lid member at an end of the pressurizing stroke of said pressurizing member.

3. A press device according to claim 1, wherein said pressurizing member has at least one guide pin extending in the axial direction of said press device while said lid member has at least one guide hole formed therein for receiving said guide pin, said guide pin and said guide hole are engaged with each other in such a telescopic relationship that said pressurizing member may be held on said lid member at an end of the pressurizing stroke of said pressurizing member.

4. A press device according to claim 1, wherein said lid member has a projection provided at a central portion of a face thereof remote from said pressurizing member, and said projection is fitted in and secured to said press frame.

5. A press device according to claim 1, wherein said guide means includes a plurality of guide rods securely provided on said cross head and extending in the axial direction of said press device, and a plurality of supporting holes formed in said press frame, and said guide rods are fitted for sliding movement in said supporting holes.

6. A press device according to claim 5, wherein said supporting holes are formed through said press frame while said guide rods extend through and outwardly from said supporting holes, and said cross head actuating means is connected to such extensions of said guide rods.

7. A press device according to claim 1, wherein at least three pairs of keys and key ways are provided radially from the axis of said press device on circumferential edge portions of one and the other, respectively, of said blank holder and said shaping element.

* * * * *